US011053659B1

(12) United States Patent
Parthasarathy et al.

(10) Patent No.: US 11,053,659 B1
(45) Date of Patent: Jul. 6, 2021

(54) BELL CRANK APPARATUS FOR A WORK MACHINE

(71) Applicant: DEERE & COMPANY, Moline, IL (US)

(72) Inventors: Satishkumar Parthasarathy, Pune (IN); Haris T Surya Prakash, Pune (IN); Joshua C. Heitsman, Princeton, IA (US)

(73) Assignee: Deere & Company, Moline, IL (US)

( * ) Notice: Subject to any disclaimer, the term of this patent is extended or adjusted under 35 U.S.C. 154(b) by 7 days.

(21) Appl. No.: 16/733,875

(22) Filed: Jan. 3, 2020

(51) Int. Cl.
*E02F 3/34* (2006.01)
*E02F 3/36* (2006.01)
*E02F 3/42* (2006.01)

(52) U.S. Cl.
CPC ..... *E02F 3/3411* (2013.01); *E02F 3/34* (2013.01); *E02F 3/3663* (2013.01); *E02F 3/422* (2013.01)

(58) Field of Classification Search
CPC ..... E02F 3/34; E02F 3/3405; E02F 3/3408; E02F 3/3411; E02F 3/3663; E02F 3/369; E02F 3/422
See application file for complete search history.

(56) References Cited

U.S. PATENT DOCUMENTS

| | | | | |
|---|---|---|---|---|
| 3,867,750 A * | 2/1975 | Den Bleyker | ..... | E02F 3/36 29/891 |
| 4,609,322 A | 9/1986 | Quant | | |
| 4,768,917 A | 9/1988 | Garman | | |
| 5,984,618 A | 11/1999 | Deneve et al. | | |
| 5,993,138 A | 11/1999 | Anderson et al. | | |
| 2019/0135599 A1 | 5/2019 | Myers et al. | | |

* cited by examiner

*Primary Examiner* — Saul Rodriguez
*Assistant Examiner* — Brendan P Tighe

(57) ABSTRACT

A work machine with a bell crank for coupling an attachment to a work machine includes a frame extending in a fore-aft direction, and a pair of lift arms pivotally coupled to the frame. The bell crank comprises a support member interposedly positioned between the pair of lift arms; and a first and second elongated, laterally spaced tilt levers coupled to the support member. Each tilt member may have a first pivoting link, a second pivoting link, and an aperture positioned between the first pivoting link and the second pivoting link. The aperture may comprise a first wall, a second wall, and a through-hole for coupling the tilt lever to the support member with a pin.

20 Claims, 4 Drawing Sheets

BELL CRANK APPARATUS FOR A WORK MACHINE

CROSS-REFERENCE TO RELATED APPLICATIONS

N/A

FIELD OF THE DISCLOSURE

The present disclosure relates to a bell crank apparatus for a work machine.

BACKGROUND

Work machines may be used with attachments to engage and move loads. An example of such an attachment is a bucket. The linkage mechanism coupling the attachment to the actuators of the machine include the use of a bell crank. The bell crank translates the forces between the frame of the work machine and the attachment as the machine moves forward, or when actuating movement of the attachment. Although currently available linkage mechanisms work well, there remains an opportunity to improve the function and efficiency of the work machine.

SUMMARY

This summary is provided to introduce a selection of concepts that are further described below in the detailed description and accompanying drawings. This summary is not intended to identify key or essential features of the appended claims, nor is it intended to be used as an aid in determining the scope of the appended claims.

In a first embodiment, a bell crank for coupling an attachment to a work machine may include a support member, and a first and second elongated, laterally spaced tilt levers. The work machine may include a frame extending in a fore-aft direction, and a pair of lift arms pivotally coupled to the frame on a first end of the pair of lift arms.

The support member of the bell crank may be interposedly positioned between the pair of lift arms. The first and second elongated, laterally spaced tilt levers may be coupled to the support member. Each tilt lever may comprise a first pivoting link on a first portion of the tilt lever pivotally coupled to a second end of a tilt hydraulic cylinder; a second pivoting link on a second end pivotally coupled to an attachment link, the attachment link coupling the tilt lever to the attachment, an aperture, an integrated dump stop, and an integrated rollback stop. The aperture may be positioned between the first pivoting link and the second pivoting link. The aperture may comprise a first wall, a second wall, and a through-hole extending through the first wall and the second wall for coupling the tilt lever to the support member with a pin. The pin may be a fulcrum axis during extension and retraction of a pair of tilt hydraulic cylinders. The bell crank may comprise of an integrated dump stop positioned above the aperture wherein the integrated dump stop limits the motion of the tilt lever when the integrated dump stop abuts the support member as the pair of tilt hydraulic cylinders retracts. The bell crank may comprise an integrated rollback stop positioned below the aperture. The integrated rollback stop may limit motion of the tilt lever when the integrate rollback stop abuts the support member as the pair of tilt hydraulic cylinders extend.

The bell crank may further comprise replaceable wear plates coupled to one or more of the integrated dump and the integrated rollback stop. The wear plates may also be reversable. The wear plates may comprise of an impact absorptive material.

The integrated dump stop may comprise a first recess peripheral to an upper edge of the aperture wherein the first recess extends to a portion of a rear outer surface of the tilt lever. The first recess may expose a dump stop flat surface for engaging the support member.

The integrated dump stop and the integrated rollback stop may be positioned on an inner surface of the tilt lever.

The rollback stop may comprise of a second recess peripheral to a lower edge of the aperture. The second recess may extend to a portion of the rear outer surface of the tilt lever. The second recess may expose a rollback stop flat surface for engaging the support member.

The first portion of the tilt lever from the aperture to the first pivoting link and the second portion of the tilt lever from the aperture to the second pivoting link are less in cross-section than the distance between the outside surfaces of the first wall and the second wall of the aperture.

These and other features will become apparent from the following detailed description and accompanying drawings, wherein various features are shown and described by way of illustration. The present disclosure is capable of other and different configurations and its several details are capable of modification in various other respects, all without departing from the scope of the present disclosure. Accordingly, the detailed description and accompanying drawings are to be regarded as illustrative in nature and not as restrictive or limiting.

BRIEF DESCRIPTION OF THE DRAWINGS

The detailed description of the drawings refers to the accompanying figures in which.

DETAILED DESCRIPTION

The embodiments disclosed in the above drawings and the following detailed description are not intended to be exhaustive or to limit the disclosure to these embodiments. Rather, there are several variations and modifications which may be made without departing from the scope of the present disclosure.

Figure 1:
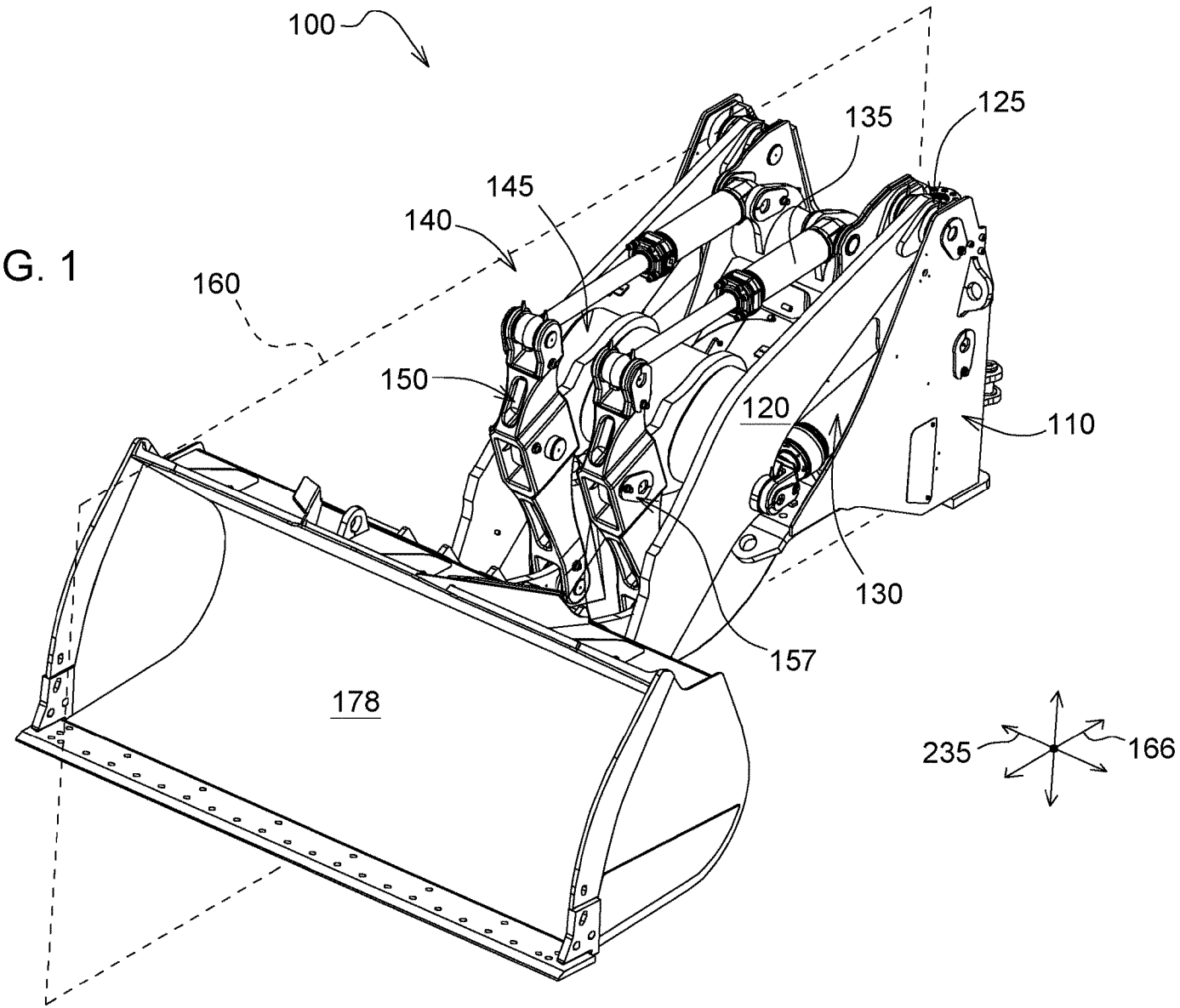
FIG. 1 is a perspective view of a work machine with the present embodiment of the bell crank.
Figure 2:
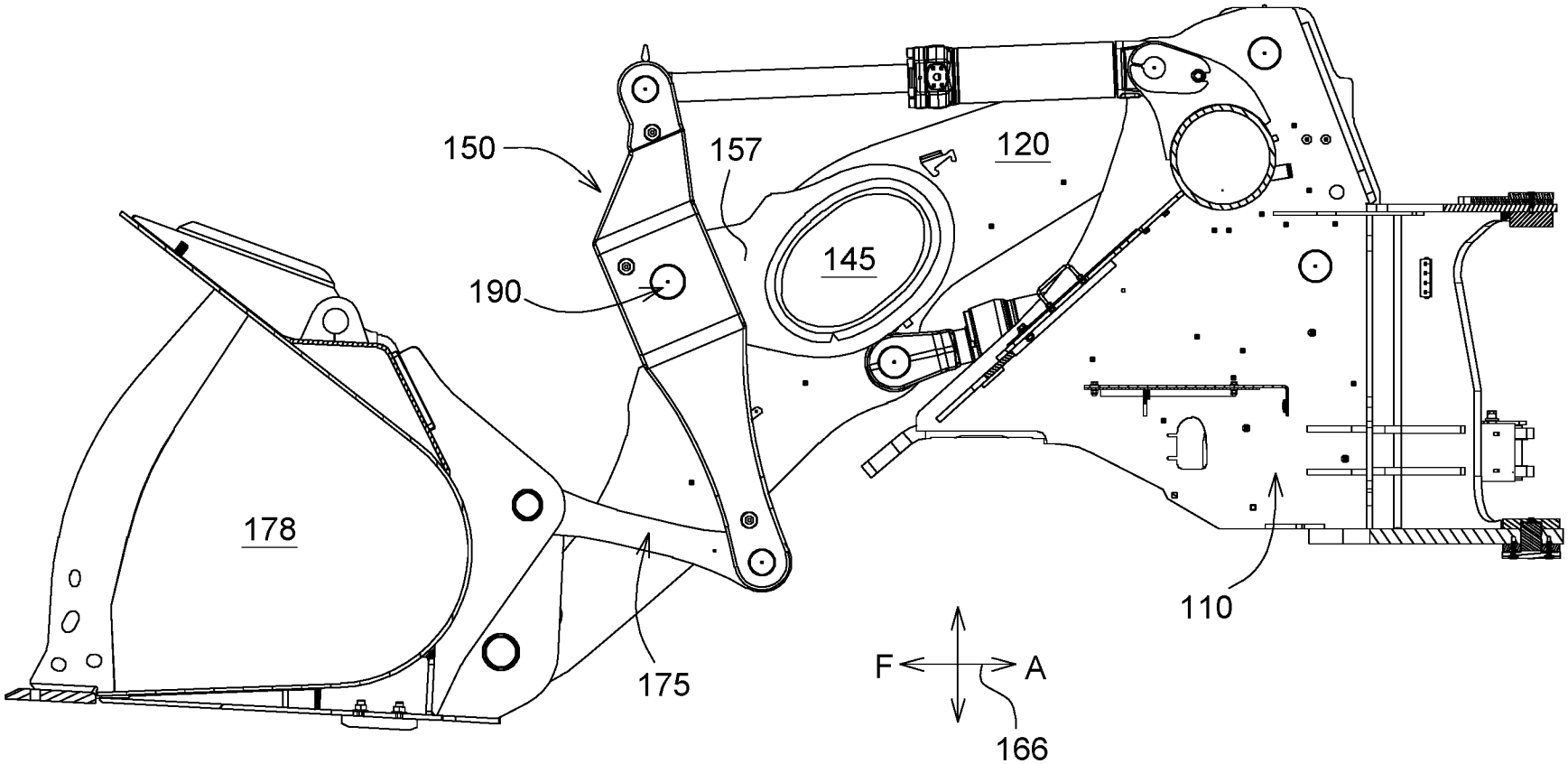
FIG. 2 is a side view of the front portion of a work machine of the embodiment shown in FIG. 1.
Figure 3:
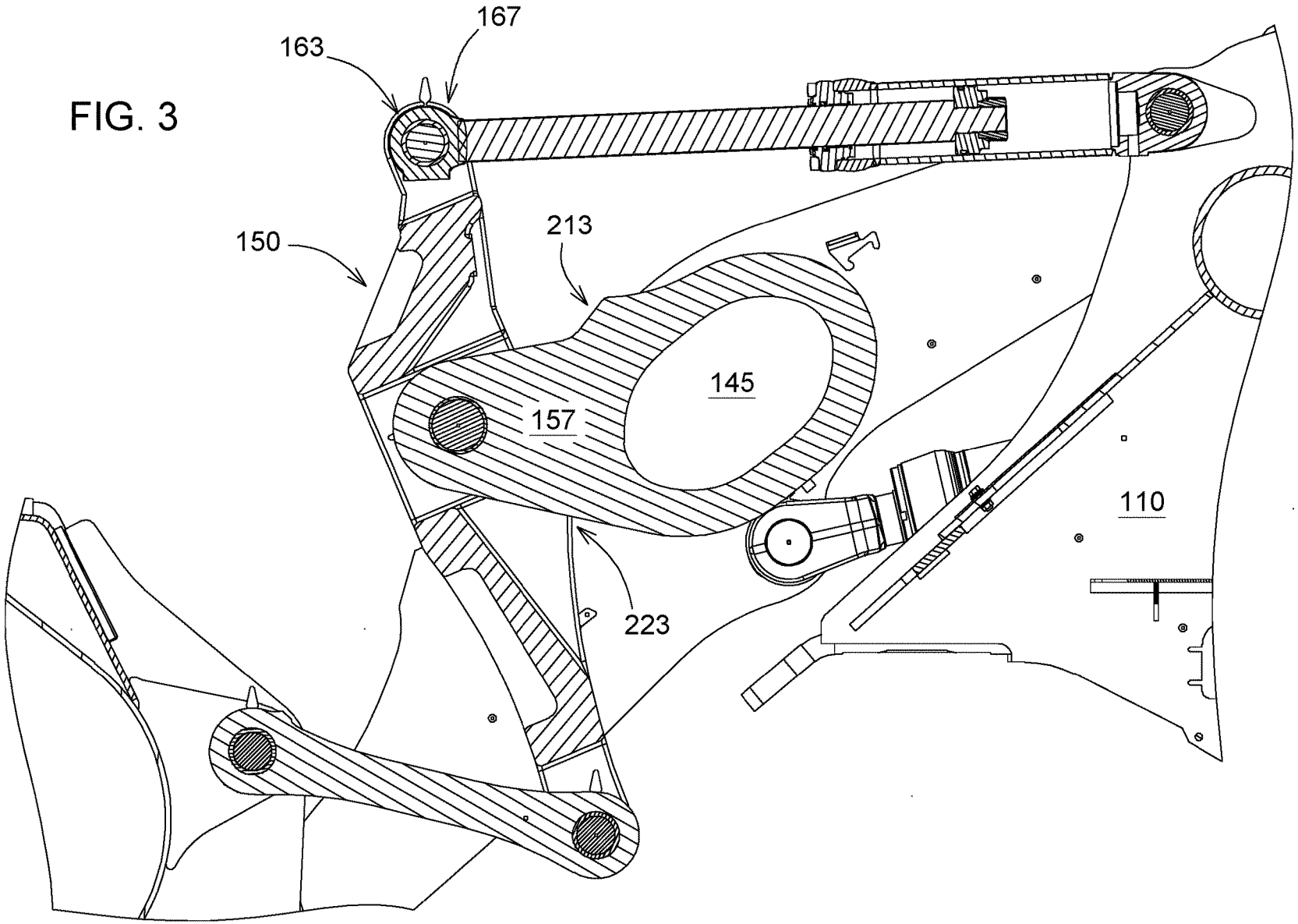
FIG. 3 is a cross-sectional side view of the front portion of a work machine of the embodiment shown in FIG. 1.

FIGS. 1 through 3 illustrate a view of a portion of a work machine 100 of the present embodiment with a bell crank 140. The work machine comprises a frame 110, a pair of lift arms 120 pivotally coupled to the frame on a first end 125 of the pair of lift arms, a pair of hydraulic cylinders 130 pivotally coupled to the frame 110 on a first end (not shown) of the pair hydraulic cylinders 130, and a bell crank 140. The bell crank 140 comprises a support member 145 coupled to the pair of lift arms 120 with a first and a second elongated, laterally spaced pair of tilt levers 150. The support member 145 may be positioned interposedly between the pair of lift arms 120. The support member 145 may further be fixedly coupled to lift arms 120, providing structural support to lift arms 120. Additionally, the support member 145 may further comprise a pair of support member pivoting links 157, laterally spaced apart about a central plane 160 extending in the for-aft direction 166, for coupling the support member 145 with the pair tilt levers 150. The central plane 160 may substantially coincide with the center axis of the work machine 100.

Figure 5:
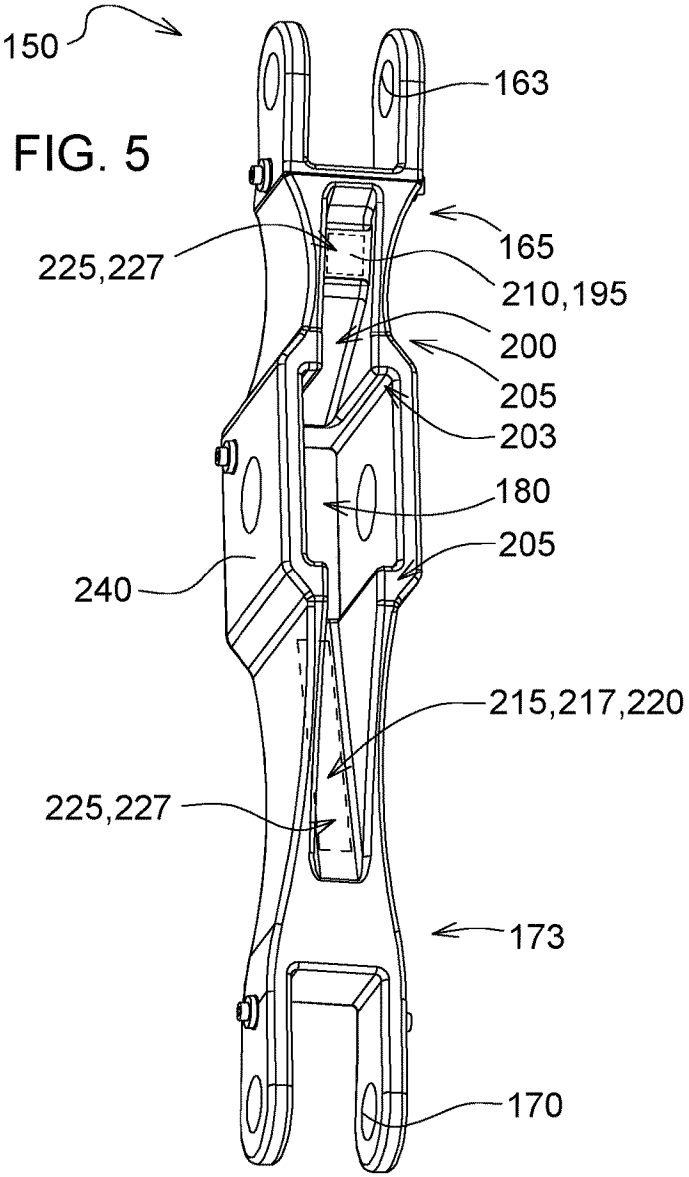
FIG. 5 is a rear perspective view of the tilt lever of the present embodiment.
Figure 4:
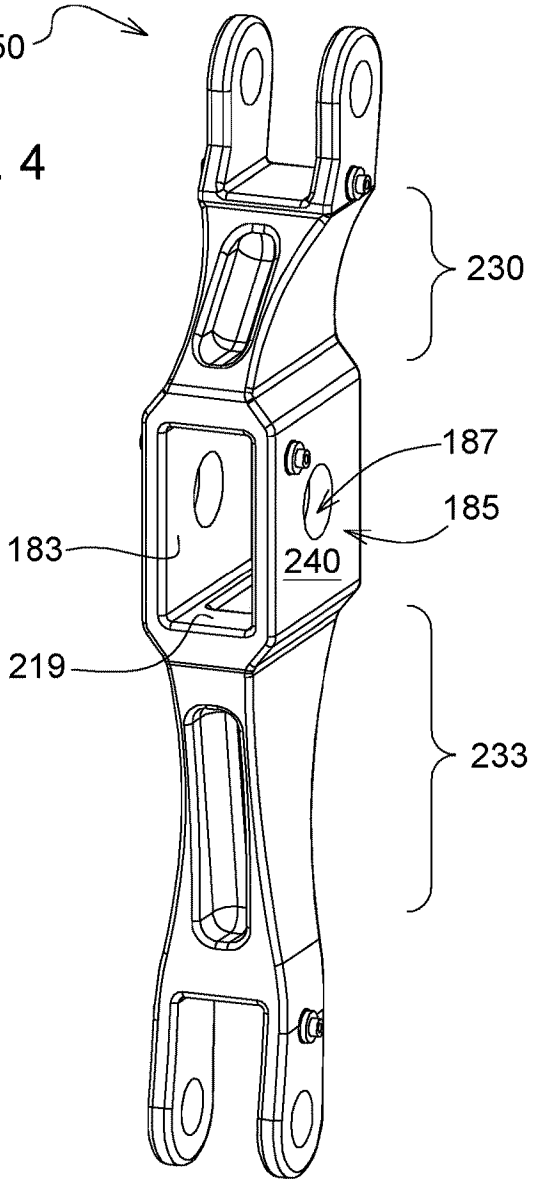
FIG. 4 is front perspective view of the tilt lever of the present embodiment.

Now referring to FIGS. 4 and 5 with continued reference to FIG. 1 through 3, each tilt lever 150 comprises a first pivoting link 163 on a first end 165 of the tilt lever 150 pivotally coupled to a second end 167 of the tilt hydraulic cylinder 135. Each tilt lever 150 may also comprise a second pivoting link 170 on a second end 173 pivotally coupled to an attachment link 175 wherein the attachment link couples the tilt lever 150 to the attachment 178. An aperture 180 may be positioned between the first pivoting link 163 and the second pivoting link 170 for coupling with the support member pivoting links 157. The aperture 180 may comprise of a first wall 183 and a second wall 185, a through-hole 187 extending through the first wall 183 and the second wall 185 wherein the tilt lever 150 is rotatably coupled to the support member 145 with a pin 190 inserted through the through-hole 187. The pin 190 may serve as the fulcrum axis during extension and retraction of the pair of tilt hydraulic cylinders 135.

The tilt lever 150 may further comprise an integrated dump stop 195 positioned above the aperture 180. The integrated dump stop 195 is integrated with the design of the tilt lever 150, creating a single-piece component. The integrated dump stop 195 (also referred to as dump stop 195 herein) may limit motion of the tilt lever 150 during dumping of the payload from the attachment 178 when the dump stop 195 abuts the support member 145 as the pair of tilt hydraulic cylinders 135 retract. In one embodiment, the dump stop 195 may comprise a surface found in a first recess 200 proximal to an upper edge 203 of the aperture 180 wherein the first recess 200 may extend to a portion of the rear outer surface 205 of the tilt lever 150. The first recess 200 exposes a dump stop flat surface 210 for engaging a first stop portion 213 on the support member 145. In the embodiment shown, the first stop portion 213 comprises the support member pivoting links 157 of the support member 145. The dump stop 195 may be positioned on an internal surface of the tilt lever 150, thereby advantageously shielding the dump stop 195 from external forces. Internally positioning of the dump stop 195 and integrating the dump stop to the tilt lever 150, advantageously creates a single-piece component eliminating wear posed by repeated impact on a welded component, streamlines the design, reduces exposure to the external environment, and reduces the number of components and possibly costs because of the reduction in the number of components. Current stops either comprise of or engage with a welded component located on an external surface of a linkage.

The tilt lever 150 may further comprise an integrated rollback stop 215 positioned below the aperture 180. Similar to the integrated dump stop 195, the integrated rollback stop 215 is integrated with the design of the tilt lever 150, creating a single-piece component. The integrated rollback stop 215 (also referred to as rollback stop 215 herein) during rollback of the attachment 178 may limit motion of the tilt lever 150 when the rollback stop 215 abuts the support member 145 as the tilt hydraulic cylinders 135 extend. In the present embodiment, the rollback stop 215 may comprise a second recess 217 peripheral to a lower edge 219 of the aperture 180. The second recess 217 may extend to a portion of the rear outer surface 205 of the tilt lever 150. The second recess 217 may expose a rollback stop flat surface 220 for engaging with the second stop portion 223 of the support member 145. More specifically, the rollback stop flat surface 220 engages with the second stop portion 223 located on the support member pivoting links 157 of the support member 145. In alternative embodiment the stop portion 223 may engage with alternate portions of the support member 145.

The tilt lever 150 may further comprise a replaceable wear plate 225 coupled to one or more of the integrated dump stop 195 and the integrated rollback stop 215. The wear plate 225 may comprise of impact absorptive material 227. That is, the impact absorption properties of the wear plate may be greater than the impact absorption properties of the tilt lever 150, advantageously improving ease of maintenance of tilt levers 150. Maintenance of the dump stop 195 and rollback stop 215 further ensures the linkage kinematics remain accurate and precise. Accuracy and precision become important in feedback loop communications with the control system of the work machine for applications such as grade control. The wear plates 225 may further be reversable, thereby doubling the use expectancy of the wear plate 225.

Additionally, an upper portion 230 of the tilt lever 150 from the aperture 180 to the first pivoting link 163, and the lower portion 233 from the aperture 180 to the second pivoting link 170 may be less in cross-section, in the lateral direction 235, than the distance between the outside surfaces 240 of the first wall 183 and the second wall 185 of the aperture 180. This reduction in cross-section of the upper portion 230 and the lower portion 233 is partially achieved by integrating the dump stops 195 and the rollback stops 215 into the tilt levers 150 and advantageously provides improved visibility of the attachment 178 for the operator from the operator cab.

The terminology used herein is for the purpose of describing particular embodiments or implementations and is not intended to be limiting of the disclosure. As used herein, the singular forms "a", "an" and "the" are intended to include the plural forms as well, unless the context clearly indicates otherwise. It will be further understood that the any use of the terms "has," "have," "having," "include," "includes," "including," "comprise," "comprises," "comprising," or the like, in this specification, identifies the presence of stated features, integers, steps, operations, elements, and/or components, but does not preclude the presence or addition of one or more other features, integers, steps, operations, elements, components, and/or groups thereof.

While the above describes example embodiments of the present disclosure, these descriptions should not be viewed in a restrictive or limiting sense. Rather, there are several variations and modifications which may be made without departing from the scope of the appended claims.

What is claimed is:

1. A bell crank for coupling an attachment to a work machine, the work machine including a frame extending in a fore-aft direction, and a pair of lift arms pivotally coupled to the frame on a first end of the pair of lift arms, the bell crank comprising:

a support member interposedly positioned between the pair of lift arms; and a first and a second elongated, laterally spaced tilt levers coupled to the support member, each tilt lever including:

a first pivoting link on a first end of the tilt lever pivotally coupled to a tilt hydraulic cylinder;

a second pivoting link on a second end of the tilt lever pivotally coupled to an attachment link, the attachment link coupling the tilt lever to the attachment;

an aperture positioned between the first pivoting link and the second pivoting link, the aperture comprising a first wall, a second wall, and a through-hole extending through the first wall and the second wall for coupling the tilt lever to the support member with a pin, the pin being a fulcrum axis during extension and retraction of a pair of tilt hydraulic cylinders;

an integrated dump stop positioned above the aperture, the integrated dump stop limiting motion of the tilt lever when the integrated dump stop abuts the support member as the pair of tilt hydraulic cylinders retract; and an integrated rollback stop positioned below the aperture, the integrated rollback stop limiting motion of the tilt lever when the integrated rollback stop abuts the support member as the pair of tilt hydraulic cylinders extend.

2. The bell crank of claim 1, wherein the bell crank further comprises a replaceable wear plate coupled to one or more of the integrated dump stop and the integrated rollback stop.

3. The bell crank of claim 1, wherein the integrated dump stop comprises a first recess peripheral to an upper edge of the aperture, the first recess extending to a portion of a rear outer surface of the tilt lever, the first recess exposing a dump stop flat surface for engaging the support member.

4. The bell crank of claim 3, wherein one or more of a replaceable and reversable wear plate is coupled to the dump stop flat surface.

5. The bell crank of claim 4, wherein the wear plate comprises an impact absorptive material.

6. The bell crank of claim 1, wherein the integrated dump stop and the integrated rollback stop are positioned on an inner surface of the tilt lever.

7. The bell crank of claim 1, wherein the rollback stop comprises a second recess peripheral to a lower edge of the aperture, the second recess extending to a portion of a rear outer surface of the tilt lever, the second recess exposing a rollback stop flat surface for engaging the support member.

8. The bell crank of claim 7, wherein the wear plate comprises an impact absorptive material.

9. The bell crank of claim 7, wherein one or more of a replaceable and reversable wear plate is coupled to the rollback stop flat surface.

10. The bell crank of claim 1, wherein a first portion of the tilt lever from the aperture to the first pivoting link and the second portion of the tilt lever from the aperture to the second pivoting link are less in cross-section than the distance between the outside surfaces of the first wall and the second wall of the aperture.

11. A work machine comprising:

a frame extending in a fore-aft direction, a pair of lift arms pivotally coupled to the frame on a first end of the pair of lift arms;

a bell crank for coupling an attachment to the work machine, the bell crank comprising a support member positioned interposedly between the pair of lift arms and a first and a second elongated, laterally spaced tilt levers coupled to the support member, each tilt lever including:

a first pivoting link on a first end of the tilt lever pivotally coupled to a second end of a tilt hydraulic cylinder, the first end of the tilt hydraulic cylinder coupled to the frame;

a second pivoting link on a second end of the tilt lever pivotally coupled to an attachment link, the attachment link coupling the tilt lever to an attachment;

an aperture positioned between the first pivoting link and the second pivoting link, the aperture comprising a first wall and a second wall, a through-hole extending through the first wall and the second wall for coupling the tilt lever to the support member with a pin, the pin being the fulcrum axis during extension and retraction of a pair of tilt hydraulic cylinders;

an integrated dump stop positioned above the aperture, the integrated dump stop limiting motion of the tilt lever when the integrated dump stop abuts the support member as the pair of tilt hydraulic cylinders retract; and an integrated rollback stop positioned below the aperture, the integrated rollback stop limiting motion of the tilt lever when the integrated rollback stop abuts the support member as the pair of tilt hydraulic cylinders extend.

12. The work machine of claim 11, wherein the bell crank further comprises a replaceable wear plate coupled to one or more of the integrated dump stop and the integrated rollback stop.

13. The work machine of claim 11, wherein the integrated dump stop comprises a first recess peripheral to an upper edge of the aperture, the first recess extending to a portion of a rear outer surface of the tilt lever, the first recess exposing a dump stop flat surface for engaging the support member.

14. The work machine of claim 13, wherein one or more of a replaceable and reversable wear plate is coupled to the dump stop flat surface.

15. The work machine of claim 14, wherein the wear plate comprises an impact absorptive material.

16. The work machine of claim 11, wherein the integrated dump stop and the integrated rollback stop are positioned on an inner surface of tilt lever.

17. The work machine of claim 11, wherein the rollback stop comprises a second recess peripheral to a lower edge of the aperture, the second recess extending to a portion of a rear outer surface of the tilt lever, the second recess exposing a dump stop flat surface for engaging the support member.

18. The work machine of claim 17, wherein the wear plate comprises an impact absorptive material.

19. The work machine of claim 17, wherein one or more of a replaceable and reversable wear plate is coupled to the rollback flat surface.

20. A work machine comprising:

a frame extending in a fore-aft direction, a pair of lift arms pivotally coupled to the frame on a first end of the pair of lift arms;

a bell crank for coupling an attachment to the work machine, the bell crank comprising a support member positioned interposedly between the pair of lift arms and a first and a second elongated, laterally spaced tilt levers coupled to the support member, each tilt lever including:

a first pivoting link on a first end of the tilt lever pivotally coupled to a second end of a tilt hydraulic cylinder, the first end of the tilt hydraulic cylinder coupled to the frame;

a second pivoting link on a second end pivotally coupled to an attachment link, the attachment link coupling the tilt lever to an attachment;

an aperture positioned between the first pivoting link and the second pivoting link, the aperture comprising a first wall and a second wall, a through-hole extending through the first wall and the second wall for coupling the tilt lever to the support member with a pin, the pin being the fulcrum axis during extension and retraction of a pair of tilt hydraulic cylinders;

an integrated dump stop positioned above the aperture, the integrated dump stop limiting motion of the tilt lever when the integrated dump stop abuts the support member as the pair of tilt hydraulic cylinders retract, a replaceable wear plate coupled to the integrated dump stop; and an integrated rollback stop positioned below the aperture, the integrated rollback stop limiting motion of the tilt lever when the integrated rollback stop abuts the support member as the pair of tilt hydraulic cylinders extend, a replaceable wear plate coupled to the integrated rollback stop.

* * * * *